United States Patent [19]

Fratti

[11] Patent Number: 4,539,714

[45] Date of Patent: Sep. 10, 1985

[54] HEAT CONDUCTIVE CLOTHING MATERIAL PARTICULARLY USEFUL IN THE FIELD OF THERMAL GARMENTS

[76] Inventor: Franco Fratti, Viale Certosa 46, Milano, Italy

[21] Appl. No.: 521,219

[22] Filed: Aug. 8, 1983

[30] Foreign Application Priority Data

Nov. 16, 1982 [IT] Italy ..... 24272 A/82

[51] Int. Cl.[3] ..... A41D 1/02

[52] U.S. Cl. ..... 2/108; 428/913; 2/93

[58] Field of Search ..... 2/2, 108, 93, 159; 126/204, 206; 428/913

[56] References Cited

U.S. PATENT DOCUMENTS

| | | | |
|---|---|---|---|
| 4,147,829 | 4/1979 | Holland | 2/243 A |
| 4,211,261 | 7/1980 | Mehta et al. | 2/2 |
| 4,255,817 | 3/1981 | Heim | 2/2 |

*Primary Examiner*—Doris L. Troutman

*Attorney, Agent, or Firm*—Guido Modiano; Albert Josif

[57] ABSTRACT

The heat conductive laminated clothing material comprises a ply or layered structure defining an inner face or lining opposing an outer face exposed to the environment surrounding it, as well as solar energy collectors associated with the outer face to pick up and spread thermal energy through the ply structure element, the collectors comprising metal foils having a light absorbing surface defined essentially by microdendritic structures associated with the foils.

7 Claims, 5 Drawing Figures

1
2
3
4
5

6
7
7
7
7
7

6
7
7

9
9
8
11
10

14
13
12

HEAT CONDUCTIVE CLOTHING MATERIAL PARTICULARLY USEFUL IN THE FIELD OF THERMAL GARMENTS

BACKGROUND OF THE INVENTION

This invention relates to heat conductive laminated clothing material particularly useful in the field of thermal garments or articles of clothing particularly useful for outdoors use or cold climate working sites.

Several types of garments are known in the specific field which are designed to protect a person wearing them from exceptionally unfavorable environmental situations.

The principle on which such garments are based, is essentially that of hindering heat transfer from the wearer's body to the surrounding atmosphere, through enhanced thermal insulation achieved by maximizing the heat-barrier properties of the plies or layers or material comprising such garments.

For that reason, conventional garments often exhibit a bulky fashioned shape and are only moderately practical in use; also known are clothing articles heated by means of electric resistance heaters concealed in the weave of the fabrics they are made of or under their padding.

With the latter approach, the problem is encountered of providing a suitable power supply source which has to be carried along by the user at all times.

That reason explains the relatively poor acceptance met by heated garments of that type, since considerations of bulk and unpracticality would overhelm the thermal advantages achieved thereby.

SUMMARY OF THE INVENTION

In the light of the above technical problems, it is a primary object of this invention to obviate such prior drawbacks by providing a heat conductive laminated clothing material particularly useful in the field of thermal garment which can deliver an amount of heat to its user without hindering his/her movements because of the presence of bulky power sources.

It is another object of this invention to provide a heat conductive laminated clothing material particularly useful in the field of thermal garment which affords a substantial reduction in the insulating plies or layers normally incorporated to prior garments without adversely affecting the heating capability of the garments.

A further object of this invention is to provide a heat conductive laminated clothing material particularly useful in the field of thermal garments which can combine high performance characteristics with significant aesthetic and decorative features, while being highly practical to use.

According to one aspect of the invention these and other objects are achieved by a heat conductive laminated clothing material particularly useful in the field of thermal garment conductive laminated clothing material comprising a laminated structure including an outer face, adapted for exposure to the ambient atmosphere and an inner face opposite to said outer face, said laminated structure further comprising at least one solar energy collector, covering at least partially said outer face and including at least one foil element, said at least one solar energy collector further including a light absorbing surface, said light absorbing surface being defined by microdendritic structures, said microdendritic structures being adapted to absorb incedent solar radiation, said at least one solar energy collector being adapted to spread thermal energy, derived from solar radiation at said light absorbing surface through said laminated structure of said heat conductive laminated clothing material a ply structure element defining an inner face or lining opposing an outer face exposed to the surrounding atmosphere, characterized in that it comprises solar energy collectors associated with said outer face effective to pick up and spread thermal energy through said ply structure element, said collectors including foil elements having a light absorbing surface essentially defined by microdendritic structures.

BRIEF DESCRIPTION OF THE DRAWINGS

Further features and advantages of the invention will be more clearly understood from the following description of preferred, though not exclusive, embodiments of a heat conductive laminated clothing material particularly useful in the field of thermal garments according thereto, as illustrated by way of example and not of limitation in the accompanying drawing, where.

DESCRIPTION OF THE PREFERRED EMBODIMENT

Figure 1:
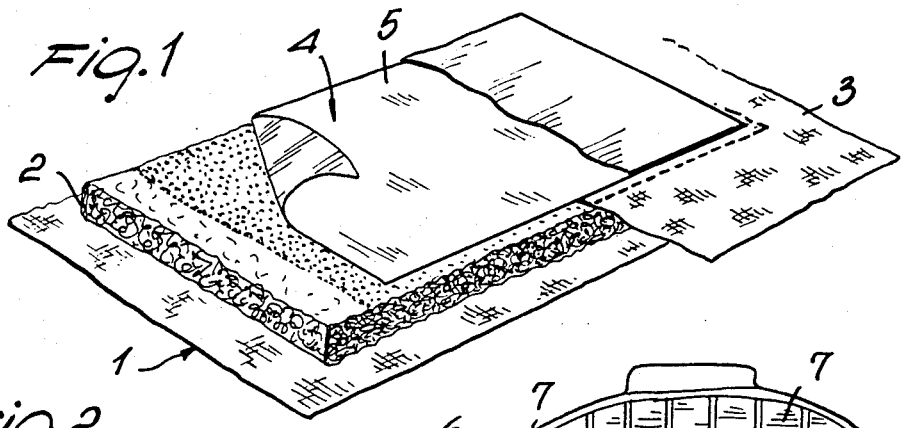
FIG. 1 is a perspective view of one possible embodiment of the heat conductive laminated clothing material according to the invention, shown in section to evidence the details or components thereof.

Making reference in particular to FIG. 1, the inventive heat conductive laminated clothing material particularly useful in the field of thermal garments comprises a laminated structure or layered element which may include, as an example, a lining 1 which defines one inner face of the garment intended to lay adjacent the body of the person who wears the garment, said lining being followed, from the inside out, by a cellular layer 2 preferably formed from an inherently insulating material the function whereof will be explained hereinafter.

Associated with the layer or ply 2, on the opposing side to the lining 1, is an outer element 3, which may be formed from a fabric or, in any case, a suitable material to provide the desired characteristics for the garment while in contact with the surrounding atmosphere, and which defines one outward face of the ply structure element.

Connected to the outer face, such as by cementing, is a solar energy collector 4 comprising substantially a foil element having a light absorbing surface 5 which carries a plurality of microdendritic structures designed to completely absorb the incident solar radiation, said solar energy collector 4 being substantially similar to the known collectors which are used to make up solar panels for heating purposes.

Since the solar energy collectors, and in particular the microdendritic structures, are extremely fragile and liable to removal by abrasion, their use as such has not been possible, and it has been necessary to coat their light absorbing surface with a film of a polymeric material which is transparent to solar radiation, said film serving the dual function of protecting the surface 5 and suppressing thermal losses by convection which would otherwise impose an apparent limitation on the use with articles of clothing which are constantly exposed to weather.

Of the cited protective materials, specially good results have been achieved with clear epoxy resins, since they can provide excellent permeability to solar radiation in combination with adequate flexibility, the latter characteristic being a vital requirement to garment manufacture.

Owing to these collectors generally comprising metal foils, they would not generally provide the elastic characteristics which are required in garment manufacture. Thus, they are unsuitable for full replacement of the element 3, because, while having appreciably high flexing capabilities, they would nevertheless provide an uncomfortably stiff feeling and emit undesired noise with the slightest movements.

Figure 2:
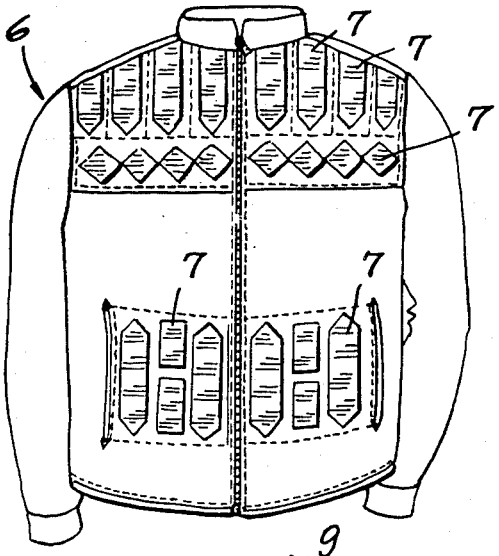
FIGS. 2 and 3 are a front view and rear view, respectively, of a thermal garment incorporating the heat conductive laminated clothing material according to the invention, in the form of a windbreaker.
Figure 3:
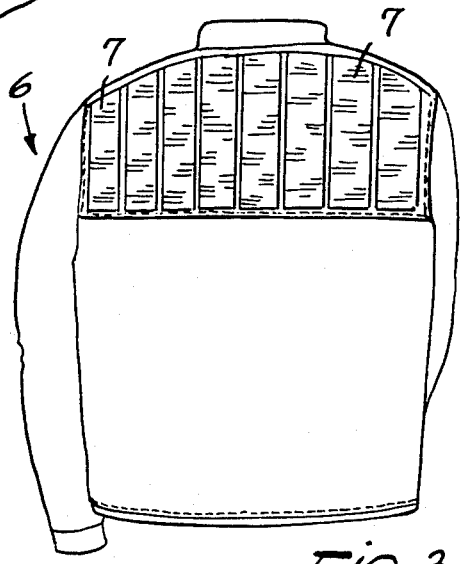

Accordingly, the Applicant has studied the possibility of dividing such solar energy collectors into a number of small size subportions which are applied mosaic-fashion onto a conventional garment structure. In FIGS. 2 and 3, for example, there is shown a windbreaker structure 6 wherein the solar energy collectors 7 are located frontally at the area of the user's breast and abdomen, and at the shoulder area on the rear of the windbreaker, thus providing, in addition to the functional characteristics specified hereinabove, also a valuable decorative theme for the garment.

Figure 4:
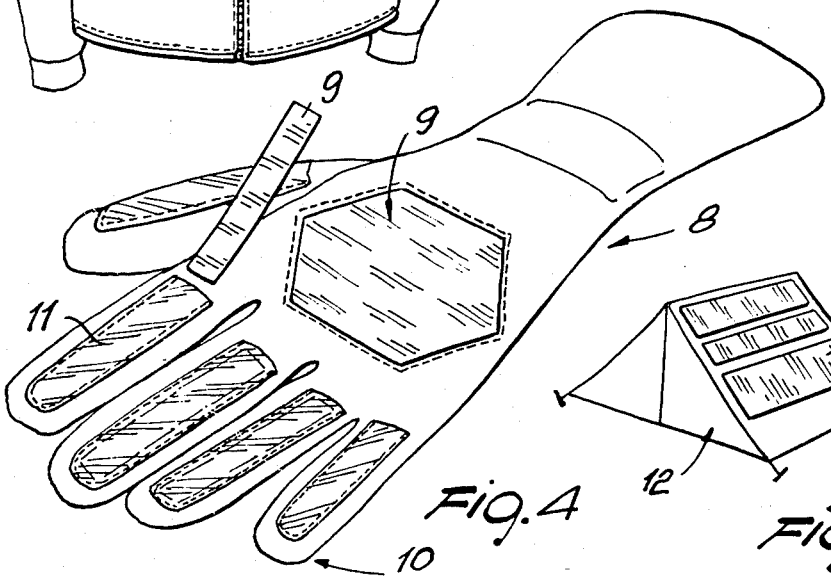
FIG. 4 shows in perspective a thermal garment according to the invention, in the form of a glove.

FIG. 4 shows a garment incorporating the heat conductive laminated clothing material according to this invention in the form of a glove, generally indicated at 8.

In the exemplary embodiment shown, a glove proper, i.e. with divided fingers and thumb 10, has been considered, but the same considerations would, of course, apply also to mittens or the like hand gear.

To meet the thermal requirements of the wearer, the fingers and thumb 10 are provided with pockets 11 of a transparent material to solar radiation, wherein the collectors solar energy 9 can be removably accommodated.

This solution appears to be preferable on account of hands being generally moved more frequently than the rest of the body, so that the collectors would be subjected to much more intense wear and deteriorate more rapidly.

The expedient of providing receiving pockets affords, therefore, the possibility of quickly and easily replacing any deteriorated collectors with new ones.

Figure 5:
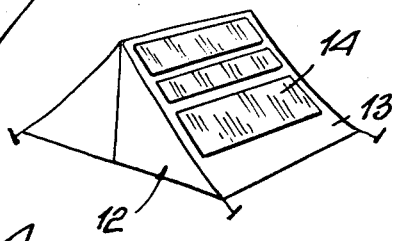
FIG. 5 illustrates a further possible application of this same invention to the field of camping tents, in particular a high mountain tent.

A similar concept would also apply to the incorporation of heat conductive laminated clothing material in the construction of camping tents, and particularly to high mountain bivouac tents, as shown schematically in the example of FIG. 5.

That figure shows a tent structure 12, the roof panels 13 whereof are associated with collectors 14 making up a ply structure element or laminated according to the invention.

The mode of operation of the heat conductive laminated clothing material according to the invention is apparent from the description and illustration provided; specifically, the solar energy collectors 4,7,9 or 14 will absorb solar radiation and integrally convert it into heat.

Convective heat exchange is prevented by the protective film which, additionally to the cited function, is also effective to counteract premature deterioration of the solar energy collectors as due to abrasive removal of the microdendrites present on the light absorbing surface.

Considering that sun radiated energy easily reaches levels in the 1000–1500 Watts/$m^2$ range, direct application of the solar energy collectors onto the lining 1 would surely be unpractical and definitely to be discouraged.

For that reason, a ply structure element is interposed which, through the intermediary of the cellular layer 2 acting as an insulator, can develop a thermal gradient between a solar energy collector and the lining, to spread the heat concentrated by the collector and deliver this heat at an appreciably lower temperature more acceptable for the human body.

The invention as outlined above is susceptible to many modifications and variations without departing from the scope of the instant inventive concept. Thus, as an example, these heating garments incorporating the heat conductive laminated clothing material according to the invention may be variously fashioned and sized, and the idea of replaceable solar energy collectors could also readily apply to the windbreaker structure described hereinabove, while the insulating layer 2 could be eliminated provided that the lining 1 presents similar characteristics to those of a cellular material.

Moreover, the solar energy collectors may have an intertwined foil type of construction to enhance their flexibility, thereby a light absorbing surface would be produced which may be likened to a fabric the weft and warp elements whereof have the thermal and physical features described hereinabove.

Further, all of the details may be replaced with other technically equivalent elements. In practicing the invention, the materials used and the dimensions may be any selected ones, depending on requirements and the state of the art.

I claim:

1. Heat conductive laminated clothing material particularly useful in the filed of thermal garments, said heat conductive laminated clothing material comprising a laminated structure including an outer face, adapted for exposure to the ambient athmosphere and an inner face opposite to said outer face, said laminated structure further comprising at least one solar energy collector, covering at least partially said outer face and including at least one foil element, said at least one solar energy collector further including a light absorbing surface, said light absorbing surface being defined by microdendritic structures, said microdendritic structures being adapted to absorb incedent solar radiation, said at least one solar energy collector being adapted to spread thermal energy, derived from solar radiation at said light absorbing surface through said laminated structure of said heat conductive laminated clothing material.

2. Heat conductive laminated material according to claim 1, wherein said laminated structure further comprises a protective film of polymeric material, said protective film of polymeric material being transparent to solar radiation and associated with said light absorbing surface defined by said microdendritic structures.

3. Heat conductive laminated material according to claim 1, wherein said laminated structure further comprises a protective film of epoxy resin material, said protective film of epoxy resin material being transparent to solar radiation and associated with said light absorbing surface defined by said microdendritic structures.

4. Heat conductive laminated material according to claim 1, wherein said laminated structure further comprises an insulating cellular layer, said insulating cellular layer being effective to develop a thermal gradient between said solar energy collectors and said inner face.

5. Heat conductive laminated material according to claim 1, wherein said solar energy collectors are removably accommodated within pockets, said pockets being transparent to solar radiation and provided on said outer face.

6. Heat conductive laminated material according to claim 1, wherein said solar energy collectors are arranged on at least a portion of said outer face.

7. Heat conductive laminated material according to claim 1 wherein said solar energy collectors are carried by said outer face in a decorative manner.

* * * * *